US011225840B2

(12) United States Patent
Gunsaulis

(10) Patent No.: US 11,225,840 B2
(45) Date of Patent: Jan. 18, 2022

(54) HORIZONTAL DIRECTIONAL DRILL STRING HAVING DUAL FLUID PATHS

(71) Applicant: The Charles Machine Works, Inc., Perry, OK (US)

(72) Inventor: Floyd R. Gunsaulis, Perry, OK (US)

(73) Assignee: The Charles Machine Works, Inc., Perry, OK (US)

( * ) Notice: Subject to any disclaimer, the term of this patent is extended or adjusted under 35 U.S.C. 154(b) by 66 days.

(21) Appl. No.: 16/414,081

(22) Filed: May 16, 2019

(65) Prior Publication Data

US 2019/0352975 A1 Nov. 21, 2019

Related U.S. Application Data

(60) Provisional application No. 62/673,252, filed on May 18, 2018.

(51) Int. Cl.

| | |
|---|---|
| ***E21B 17/04*** | (2006.01) |
| ***E21B 7/04*** | (2006.01) |
| ***E21B 17/18*** | (2006.01) |
| *E21B 17/042* | (2006.01) |

(52) U.S. Cl.

CPC ..... *E21B 17/04* (2013.01); *E21B 7/046* (2013.01); *E21B 17/18* (2013.01); *E21B 17/042* (2013.01)

(58) Field of Classification Search

CPC ..... E21B 17/18; E21B 21/12; E21B 21/00

See application file for complete search history.

(56) References Cited

U.S. PATENT DOCUMENTS 3,998,479 A * 12/1976 Bishop ..... E21B 17/04 285/123.3
7,066,283 B2 6/2006 Livingstone
7,204,327 B2 4/2007 Livingstone
(Continued)

FOREIGN PATENT DOCUMENTS

WO 01/59248 8/2001

OTHER PUBLICATIONS

Matrix Drilling Products, "Part 1 of 3—Intro To Drilling With DT Reverse Air And Flooded Reverse Methods", article, printed from website Mar. 18, 2019, 3 pages.
(Continued)

*Primary Examiner* — Kristyn A Hall
(74) *Attorney, Agent, or Firm* — Tomlinson McKinstry, P.C.

(57) ABSTRACT

A pipe assembly has a hollow inner member nested within a hollow outer member. A series of pipe assemblies are connected end-to-end to form a dual-member drill string useful in horizontal directional drilling operations. The drill string has mutually exclusive first and second fluid paths. Fluid seals, interposed between adjacent inner members of the string, isolate the first fluid path from the second fluid path. Compressed air is delivered into the first fluid path from above ground level, and routed to an underground boring tool. The expelled air and spoils are returned to above ground level by way of the second fluid path. One or more baffle elements are supported on the drill string adjacent the boring tool. The baffle elements are configured to prevent compressed air and spoils from flowing between the walls of the borehole and the drill string.

22 Claims, 15 Drawing Sheets

(56) References Cited

U.S. PATENT DOCUMENTS

| | | | | |
|---|---|---|---|---|
| 10,280,690 | B2 | 5/2019 | Wilson et al. | |
| 2013/0133953 | A1 | 5/2013 | Burca et al. | |
| 2015/0233192 | A1* | 8/2015 | Slaughter, Jr. | E21B 7/046 175/320 |
| 2016/0053550 | A1* | 2/2016 | Wilson | E21B 10/42 175/393 |
| 2016/0245025 | A1* | 8/2016 | Slaughter, Jr. | E21B 7/046 |
| 2017/0218738 | A1* | 8/2017 | Livescu | E21B 43/129 |
| 2018/0223613 | A1 | 8/2018 | Hatfield | |

OTHER PUBLICATIONS

Matrix Drilling Products, Underground Dual Tube Info Slide which were offered for sale in the United States more than 1 year prior to May 18, 2018, undated, 1 page.

* cited by examiner

HORIZONTAL DIRECTIONAL DRILL STRING HAVING DUAL FLUID PATHS

SUMMARY

The present invention is directed to a pipe assembly comprising a hollow outer member and a hollow inner member. The inner member has a longitudinal internal bore and is at least partially nested within the outer member and cooperates with the outer member to define boundaries of an annular space. The inner member is characterized by a pin end having a polygonal outer profile and an opposed box end having a polygonal inner profile. An endless groove is formed in the inner member and surrounds the internal bore. A fluid seal is received within the endless groove.

The present invention is also directed to a drill string having a first end situated in an underground borehole and an opposed second end situated above ground. The drill string comprises a plurality of pipe assemblies arranged in end-to-end and torque-transmitting relationship. Each pipe assembly comprises a hollow outer member and a hollow inner member. The inner member has a longitudinal internal bore and is at least partially nested within the outer member and cooperates with the outer member to define boundaries of an annular space. The annular spaces of the plurality of pipe assemblies comprise segments of a first fluid path within the drill string. The internal bores of the plurality of pipe assemblies comprise segments of a second fluid path within the drill string. The drill string further comprises a plurality of fluid seals. Each fluid seal is interposed between adjacent pipe assemblies of the drill string and surrounds the second fluid path.

The present invention is further directed to an elongate drill string having a first end situated in an underground borehole, an opposed second end situated above ground, and mutually exclusive first and second fluid paths. Each fluid path extends between the first and second ends. The drill string comprises a plurality of pipe assemblies arranged in end-to-end and torque-transmitting relationship, each pipe assembly includes segments of the first fluid and second fluid paths. The first fluid path surrounds the second fluid path. The drill string further comprises a plurality of fluid seals. Each fluid seal is interposed between adjacent pipe assemblies of the drill string and surrounds the second fluid path.

DETAILED DESCRIPTION

Figure 1:
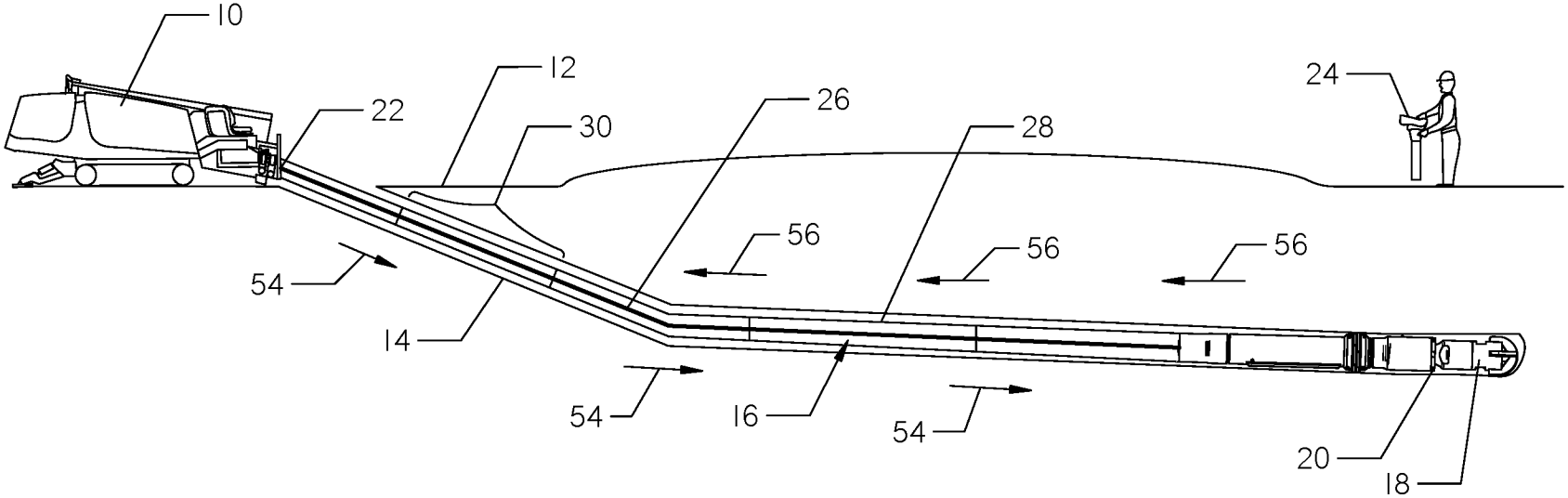
FIG. 1 is an illustration of a horizontal directional drilling operation using a dual-member drill string.

Turning now to the figures, FIG. 1 shows a horizontal directional drilling machine 10 positioned at a ground surface 12. Horizontal directional drilling machines are used to replace underground utilities with minimal surface disruption. In operation, the machine 10 drills a borehole 14 in a substantially horizontal direction underground using a drill string 16 attached to a boring tool 18. The drill string 16 has opposed first and second ends 20 and 22. The first end 20 is situated underground within the borehole 14 and is attached to the boring tool 18. The second end 22 is situated above the ground surface 12 and is gripped by the machine 10. A transmitter or beacon is included in the drill string 16 adjacent its first end 20. An operator tracks the location of the beacon underground using an above-ground tracker 24. In alternative embodiments, tracking information may be transmitted to the ground surface through the drill string using wireless telemetry, such as that described in U.S. Patent Publication No. 2013/0014992, authored by Sharp et al.

In traditional horizontal directional drilling operations, a water-based drilling fluid is delivered downhole to a boring tool through a drill string. The drilling fluid is used to clear spoils from the boring tool, cool the boring tool, reduce friction, and help stabilize the borehole. Chemical additives and refined clay materials may be added to the fluid in order to enhance the fluid's desired effects. Such materials may include commercially available polymer formations, detergents or surfactants, and other materials that can protect or stabilize a borehole wall. The drilling fluid is also used to carry spoils generated by the boring tool from the borehole to the ground surface. The drilling fluid and entrained spoils are typically carried to the ground surface through the annulus formed between the walls of the borehole and the drill string.

While drilling fluid has many advantages, its associated costs typically account for a substantial portion of the overall expense of a single drilling job. Such expenses are not limited to the actual costs of the fluid and its additives. In addition, there are labor and other costs associated with preparation, delivery, injection and disposal of the fluid. Should the fluid inadvertently be released into the environment, there will be remediation costs as well.

The horizontal directional drilling system described herein reduces these costs by using compressed air, rather than liquid, as a primary component of the drilling fluid. A minor amount of a water-based liquid may be incorporated into the airstream to help with dust suppression, friction reduction, and borehole stabilization. The liquid, for example, may be injected into the air stream at a rate of five gallons (18.9 liters) per minute, or less. In contrast, a primarily liquid based drilling fluid may be delivered to the same drill string at a rate of 30-40 gallons (114-151 liters) per minute. If a mud motor were used with the same drill string, the required fluid flow could be up to 250 gallons (950 liters) per minute. The liquid incorporated into the airstream may include the same kinds of additives that are added to traditional drilling fluids. The compressed air and liquid mixture will be referred to herein as "fluid".

Figure 2:
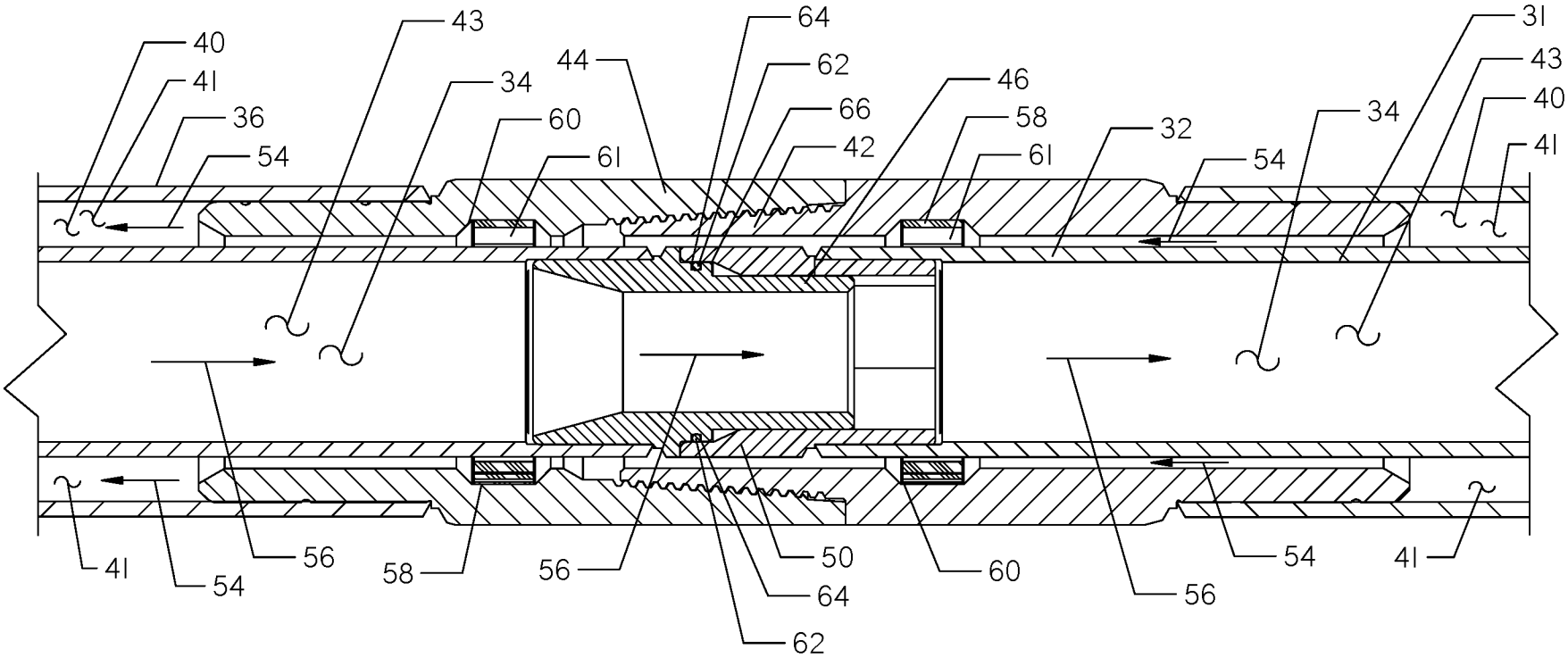
FIG. 2 is a cross-sectional view of one of the pipe joints making up the dual-member drill string shown in FIG. 1.

With reference to FIGS. 1 and 2, the drill string 16 is a dual-member drill string that comprises an elongate inner string 26 and an elongate outer string 28. The drill string 16 is made of dual-member pipe assemblies 30 attached end-to-end. Each pipe assembly 30 comprises a hollow inner member 32 having a longitudinal internal bore 34, and a hollow outer member 36, as shown in FIG. 2. The inner member 32 is at least partially nested within the outer member 36 such that the inner member and outer member cooperate to define boundaries of an annular space 40.

The dual-member drill string 16 is formed by assembling the inner string 26 and the outer string 28. The outer string 28 is formed from a series of outer members 36 arranged in end-to-end engagement. Adjacent outer members 36 are preferably coupled with a torque-transmitting threaded connection. Each outer member 36 has a threaded male end 42 and an opposed threaded female end 44, as shown in FIG. 2. Mating of a male end 42 with an adjacent female end 44 forms the threaded connection.

Figure 3:
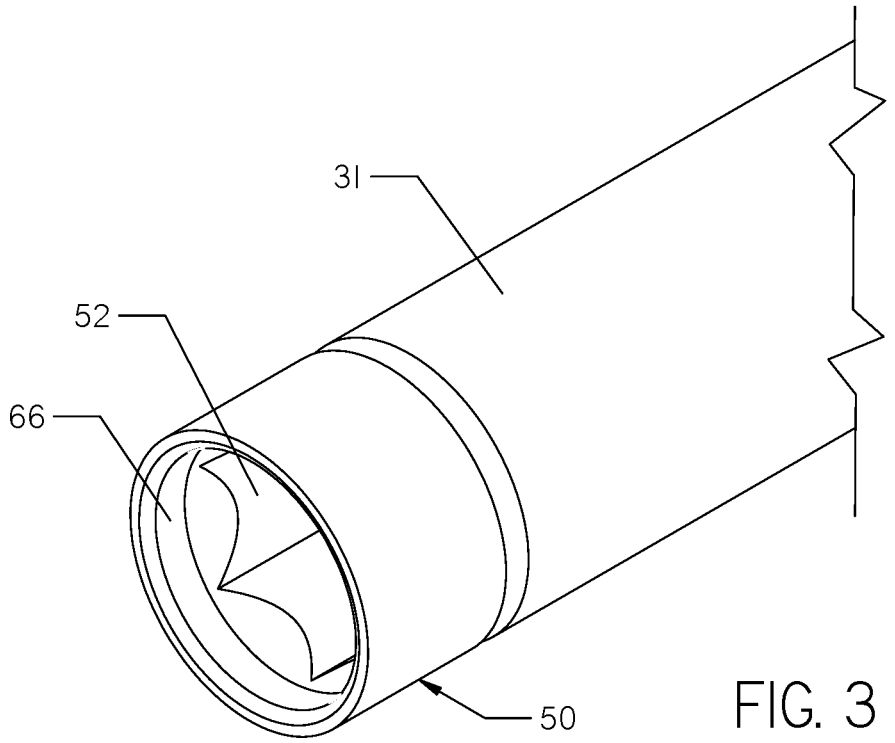
FIG. 3 is a perspective view of a box end of the inner member shown in FIG. 2.
Figure 4:
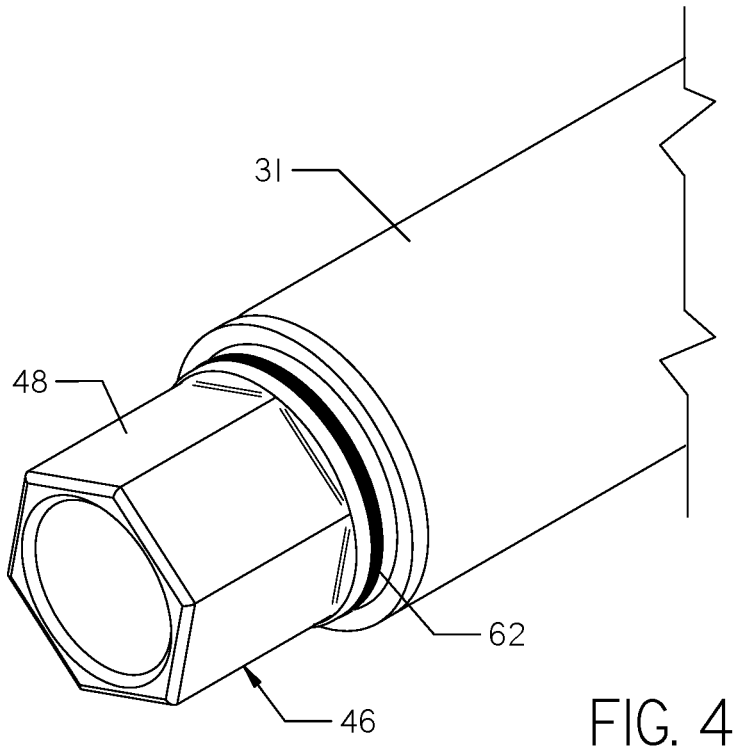
FIG. 4 is a perspective view of a pin end of the inner member shown in FIG. 2.

The inner string 26 extends within the outer string 28 and is formed from a series of inner members 32 arranged in end-to-end engagement. Adjacent inner members 32 are preferably coupled with a torque-transmitting non-threaded connection. Each inner member 32 has an elongate body 31 extending between opposed connector sections. The connector sections comprise a pin end 46 and an opposed box end 50. The body 31 has a circular outer and inner profile. In contrast, the pin end 46 preferably has a polygonal outer profile 48, as shown in FIG. 4, and the box end 50 has a polygonal inner profile 52, as shown in FIG. 3. The inner profile 52 of the box end 50 is preferably complementary to the outer profile 48 of the pin end 46. In alternative embodiments, the polygonal inner profile of the box end may not be complementary to the polygonal outer profile of the pin end, as described in U.S. Pat. No. 9,803,433, issued to Slaughter el al, the entire contents of which are incorporated herein by reference.

In alternative embodiments, the pin end of the inner member may have an outer profile having an oval, trioval, star, or splined shape. The inner profile of the box end of the inner member may be complementary to the chosen shape of the pin end. In further alternative embodiments, the elongate body of the inner member may have a polygonal outer profile along its length.

Adjacent inner members 32 are connected by mating the pin end 46 with the box end 50 in a "slip fit" manner. Torque is transmitted between adjacent inner members 32 by engagement of the profiles 48 and 52. A non-threaded, "slip fit" connection between adjacent inner members 32 permits swifter assembly of the drill string 16 than if a threaded connection is used.

Continuing with FIG. 2, the annular spaces 40 formed in the plurality of adjacent pipe assemblies 30 comprise segments of a first fluid path 41. Likewise, the internal bores 34 formed in the plurality adjacent inner members 32 comprise segments of a second fluid path 43. Thus, the first fluid path 41, which has an annular cross-sectional shape, surrounds the second fluid path 43, which has a circular cross-sectional shape. As will be described in more detail herein, the first fluid path 41 and the second fluid path 43 are mutually exclusive. Fluid flowing along the first fluid path 41 flows from the ground surface 12 to the boring tool 18, as shown by arrows 54 in FIGS. 1 and 2. While fluid flowing along the second fluid path 43 flows from the boring tool 18 to the ground surface 12, as shown by arrows 56 in FIGS. 1 and 2. Thus, the direction of fluid flow along the second fluid 43 path is opposed to the direction of fluid flow along the first fluid path 41.

A plurality of annular spacers 58 may be positioned within the annular spaces 40. The spacers 58 are disposed around the outer surface of the inner members 32 and are configured to maintain the inner and outer members 32 and 36 in a concentric relationship. The spacers 58 are each made of a durable, abrasion-resistant plastic, such as UHMW or HDPE. Alternatively, the spacers may be made of metal, such as bronze, or a composite material.

Each spacer 58 is held within an endless groove 60 formed in the inner surface of the outer member 36 and is traversed by at least one fluid passage 61. Thus, fluid flowing along the first fluid path 41 passes through the fluid passages 61 formed in each spacer 58. Each pipe assembly 30 is preferably equipped with two spacers 58. As shown in FIG. 2, one spacer 58 is positioned within a groove 60 formed within the male end 42, and the other spacer 58 is positioned in the opposed female end 44 of the outer member 36.

A collar, not shown in the figures, may be disposed around the outer surface of the inner member. The collar may be configured to limit axial movement of the inner member relative to the outer member of the pipe assembly. Examples of collars that may be used with the pipe assembly 30 are described in U.S. Pat. No. 10,260,287, issued to Slaughter et al., the entire contents of which are incorporated by reference herein.

During operation, the first fluid path 41 needs to remain sealed from the second fluid path 43. If fluid leaks between the paths, the compressed air within the first fluid path 41 may lose some of its required pressure. A drop in pressure may prevent effective delivery of the fluid from the ground surface 12 to the boring tool 18. In order to seal the fluid paths from one another, a fluid seal 62 is interposed between adjacent inner members 32, as shown in FIG. 2.

In the embodiment shown in FIGS. 2-4, an endless groove 64 is formed in outer surface of the pin end 46 of the inner member 32. The groove 64 extends concentrically around the internal bore 34 of the inner member 32. The fluid seal 62, which is annular in shape, is positioned within the groove 64. The fluid seal 62 shown in FIGS. 2 and 4 is an O-ring. In alternative embodiments, the seal may be lip seals, packings, x-ring seals, or other suitable seals made of a resilient sealing material.

When adjacent inner members 32 are connected, the seal 62 engages a flat inner surface 66 of the box end 50 of an adjacent inner member 32. Such engagement creates a seal between adjacent inner members 32. Each of the fluid seals 62 along the drill string 16 surrounds the second fluid path 43, but not the first fluid path 41, and thereby prevents interpath leakage.

The groove 64 shown in FIGS. 2 and 4 is preferably formed on an external portion of the inner member 32, most preferably at the junction between the body 31 and the pin end 46. However, in alternative embodiments, the groove may be formed at any desired position along the pin end. In further alternative embodiments, the endless groove may be formed in the inner surface of the box end. When adjacent inner members are connected and a seal is installed in the groove, the seal engages the outer surface of the pin end of the adjacent inner member.

Turning back to FIG. 1, the inner string 26 may rotate independently of the outer string 28. The inner string 26 provides rotary power and thrust to the boring tool 18, while the outer string 28 controls the angular orientation of a steering feature. The steering feature enables the drill string 16, and its attached boring tool 18, to deflect in a desired direction from a straight-line path. The steering feature may be a deflection shoe or bent sub included in the outer string 28 adjacent the boring tool 18. The drill string 16 is steered by extending it underground without rotation of the outer string 28, as rotation of the inner string 26 continues. The drill string 16 may be advanced along a substantially straight-line path by simultaneously rotating both the outer and inner strings 28 and 26.

Figure 5:
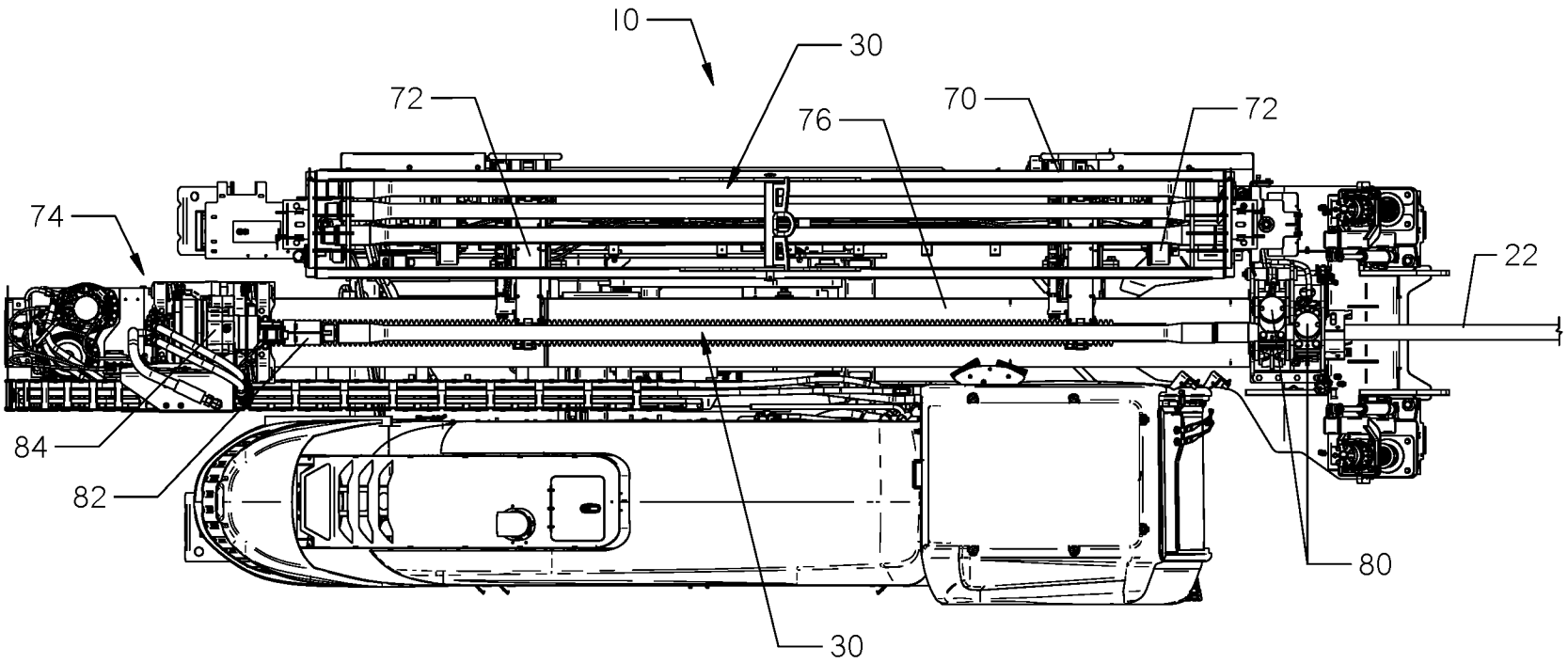
FIG. 5 is a top plan view of a horizontal directional drilling machine.

Turning to FIG. 5, the individual pipe assemblies 30 are stored in a pipe box 70 supported on the machine 10. A pipe handling assembly 72 moves the pipe assemblies 30 between the pipe box 70 and a carriage 74. The carriage 74 attaches or removes individual pipe assemblies 30 to and from the second end 22 of the drill string 16. The second end 22 of the drill string 16 is held in position for the carriage 74 by a set of clamps 80 positioned at the front of the machine 10. The carriage 74 moves laterally along a drill frame 76 to advance or retract the drill string 16 from the borehole.

With reference to FIGS. 5-8, the carriage 74 comprises a dual-member spindle 82 supported within a gearbox 84. Pipe assemblies 30 delivered from the pipe box 70 to the carriage 74 are attached to the spindle 82. The spindle 82 traverses the length of the gearbox 84 and projects from its front and rear ends 86 and 88.

Figure 8:
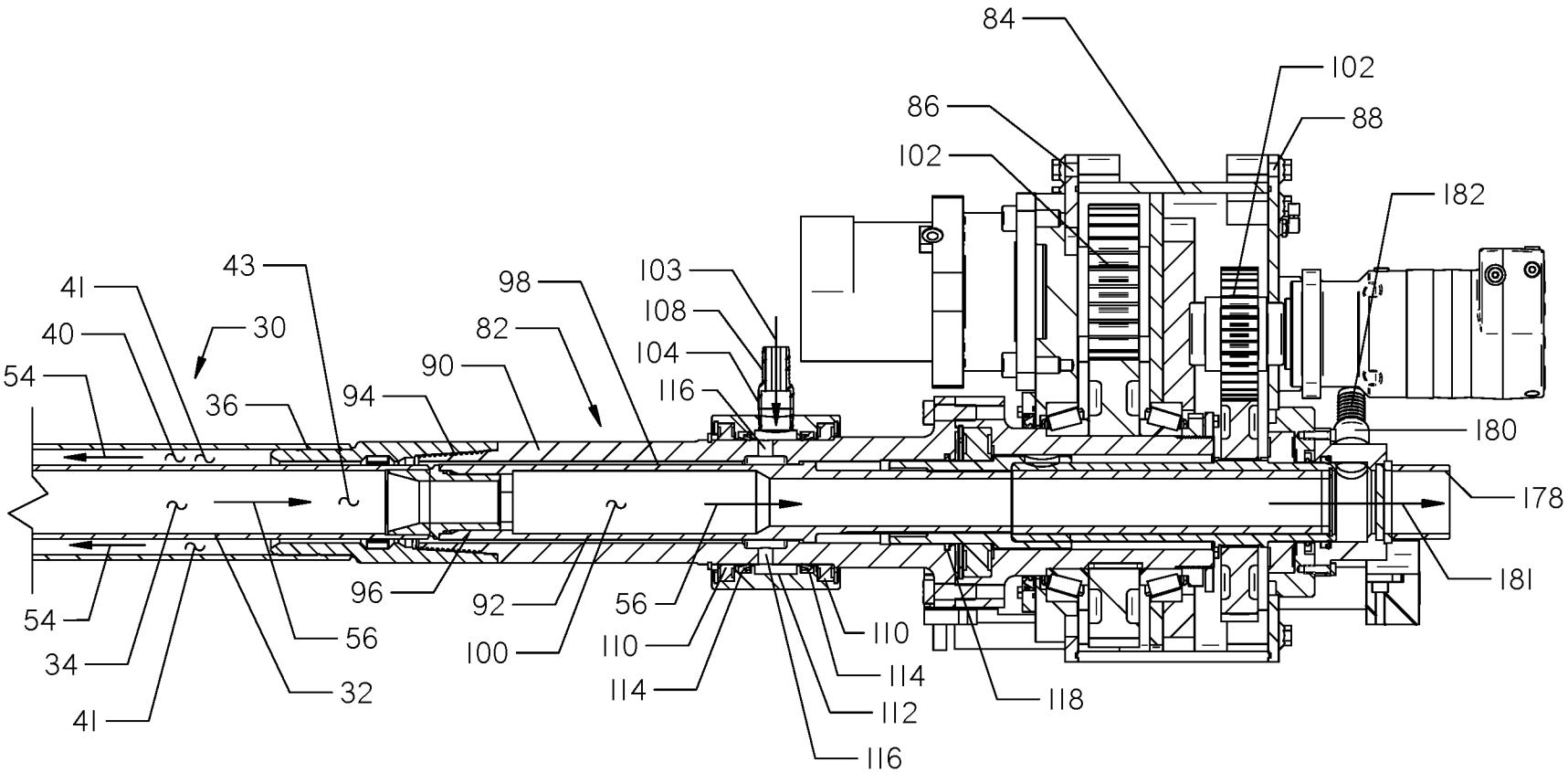
FIG. 8 is a cross-sectional view of the dual-member spindle, gearbox, and pipe assembly shown in FIG. 7, taken along line A-A. A portion of the motors included within the gearbox are not shown in cross-section so that the motors are easier to view.

Continuing with FIG. 8, the spindle 82 comprises an outer member 90 and an inner member 92. The outer member 90 has a threaded end 94 that is configured to mate with an outer member 36 of a pipe assembly 30. Likewise, the inner member 92 has a non-threaded end 96 that is configured to mate with an inner member 32 of a pipe assembly 30.

Like the pipe assembly 30, the inner member 92 of the spindle 82 is at least partially nested within the outer member 90 so that the members 90 and 92 cooperate to define boundaries of an annular space 98. When a pipe assembly 30 is attached to the spindle 82, the annular space 98 communicates with the annular space 40 formed within the pipe assembly 30. An internal bore 100 is also formed in the inner member 92 of the spindle 82. When a pipe assembly 30 is attached to the spindle 82, the internal bore 100 communicates with the internal bore 34 formed in the inner member 32 of the pipe assembly 30.

The spindle 82 drives independent rotation of both the inner and outer string 26 and 28. Rotation of the spindle 82 is driven by motors 102 supported within the gearbox 84. Rotation of the spindle 82 is stopped when a new pipe assembly 30 is to be added to the drill string 16. After this addition step has been completed, rotation of the spindle 82, and thus of the newly-enlarged drill string 16, may resume.

Figure 6:
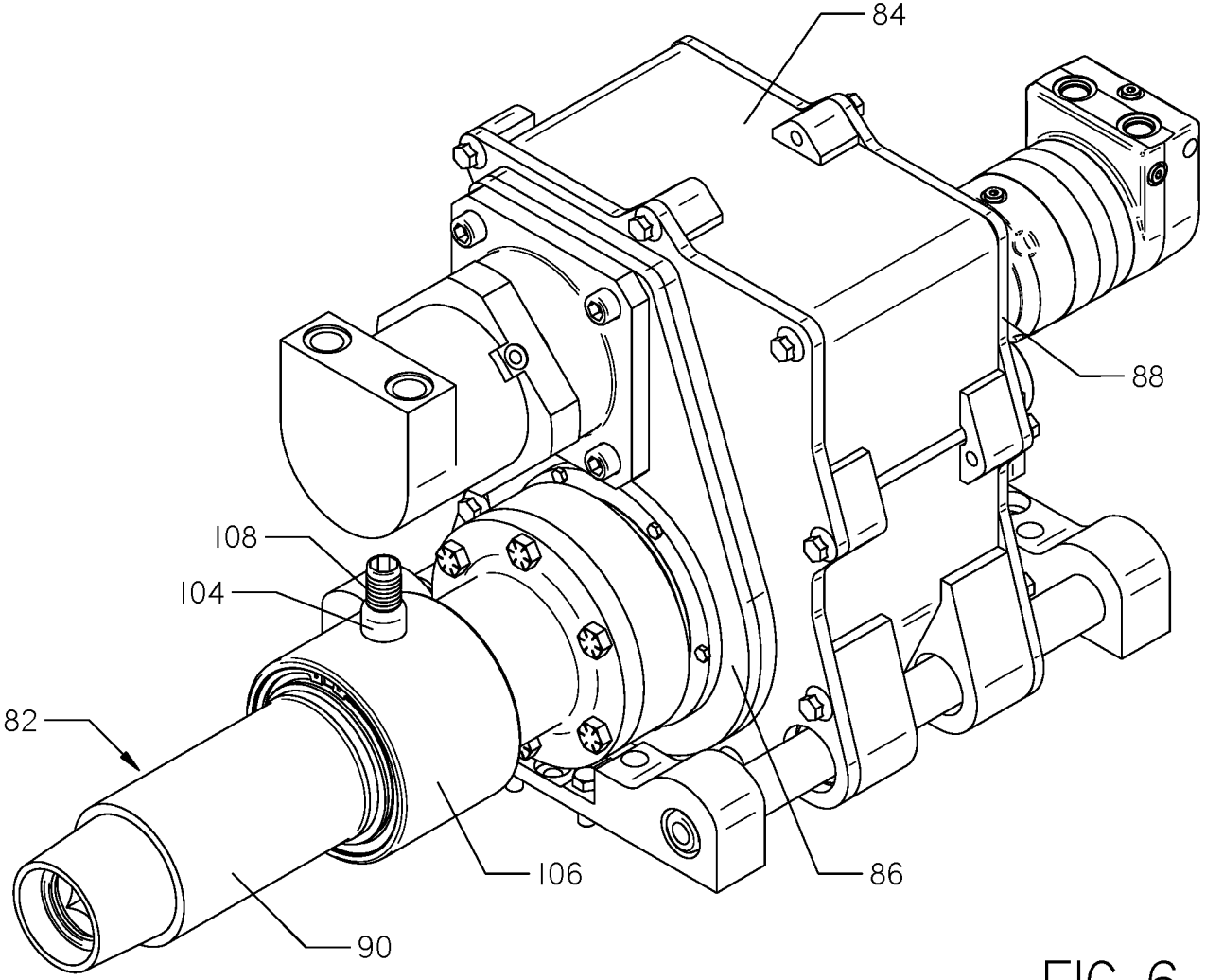
FIG. 6 is a right side perspective view of a dual-member spindle supported within a gearbox included in the horizontal directional drilling machine shown in FIG. 5.
Figure 7:
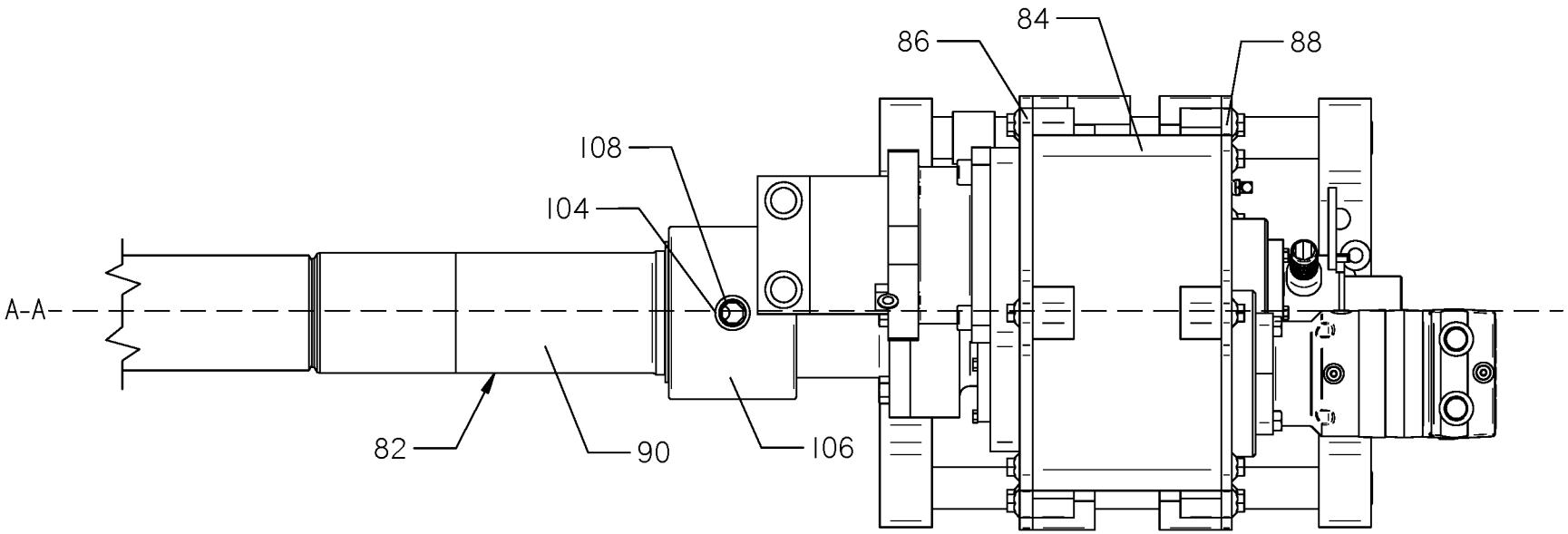
FIG. 7 is a top plan side view of the dual-member spindle and gearbox shown in FIG. 6. A portion of a pipe assembly is shown attached to the dual-member spindle.

With reference to FIGS. 6-8, fluid is delivered to the first fluid path 41 through an injection inlet 104. The injection inlet 104 is supported on a swivel 106 disposed around the outer member 90 of the spindle 82. The injection inlet 104 comprises a coupler 108 configured for connection to a hose used to supply the fluid.

Continuing with FIG. 8, a series of bearings 110 are positioned between the swivel 106 and the outer member 90. The bearings 110 allow swivel 106 to rotate relative to the spindle 82 so that the injection inlet 104 may be selectively positioned. The swivel 106 may be attached to a non-rotating portion of the spindle 82 so that rotation of the outer member 90 will not rotate the swivel 106 or the attached hose.

An internal cavity 112 is formed in the interior of the swivel 106 that communicates with the injection inlet 104. A pair of rotary seals 114 are positioned on opposite sides of the cavity 112 to prevent fluid from leaking from the swivel 106. A plurality of ports 116 are formed in the outer member 90 of the spindle 82 that interconnect the annular space 98 and the internal cavity 112. Fluid injected into the inlet 104, as shown by arrow 103, flows into the cavity 112, through the ports 116 and into the annular space 98. From there, the fluid continues along the first fluid path 41, shown by arrow 54 in FIG. 8, and towards the boring tool 18. A rotary seal 118 is also positioned within the annular space 98 of the spindle 82 adjacent the front end 86 of the gearbox 84. The seal 118 prevents fluid from leaking into the gearbox 84 after it is injected into the annular space 98.

Figure 11:
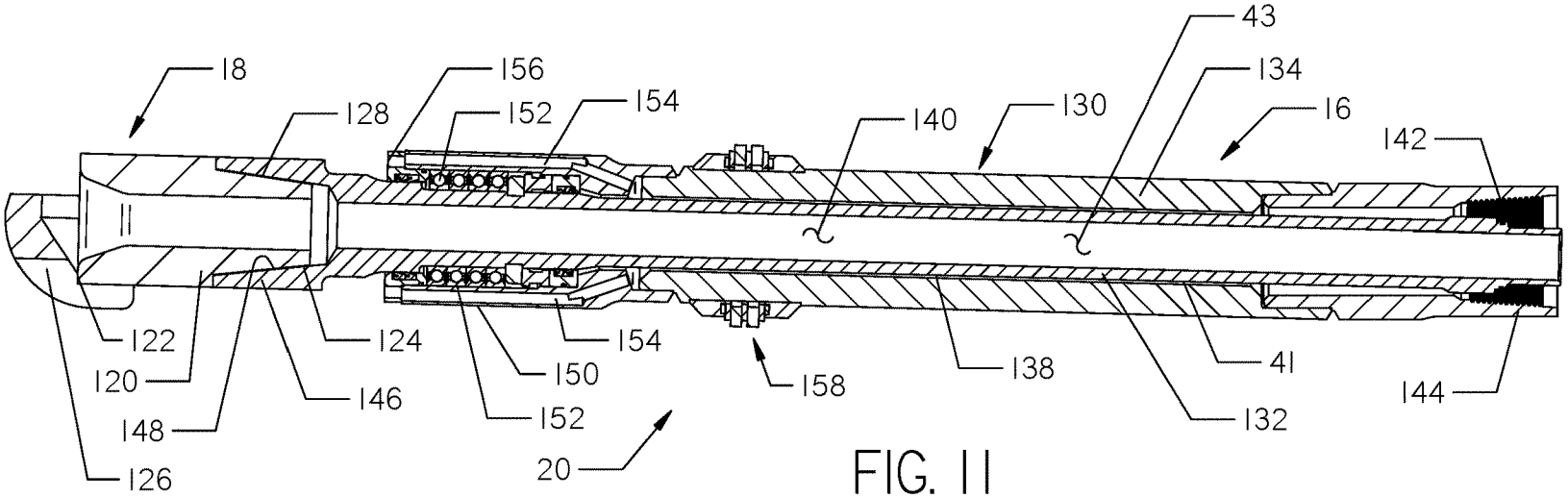
FIG. 11 is a cross-sectional view of the downhole tool shown in FIG. 10, taken along line B-B.
Figure 12:
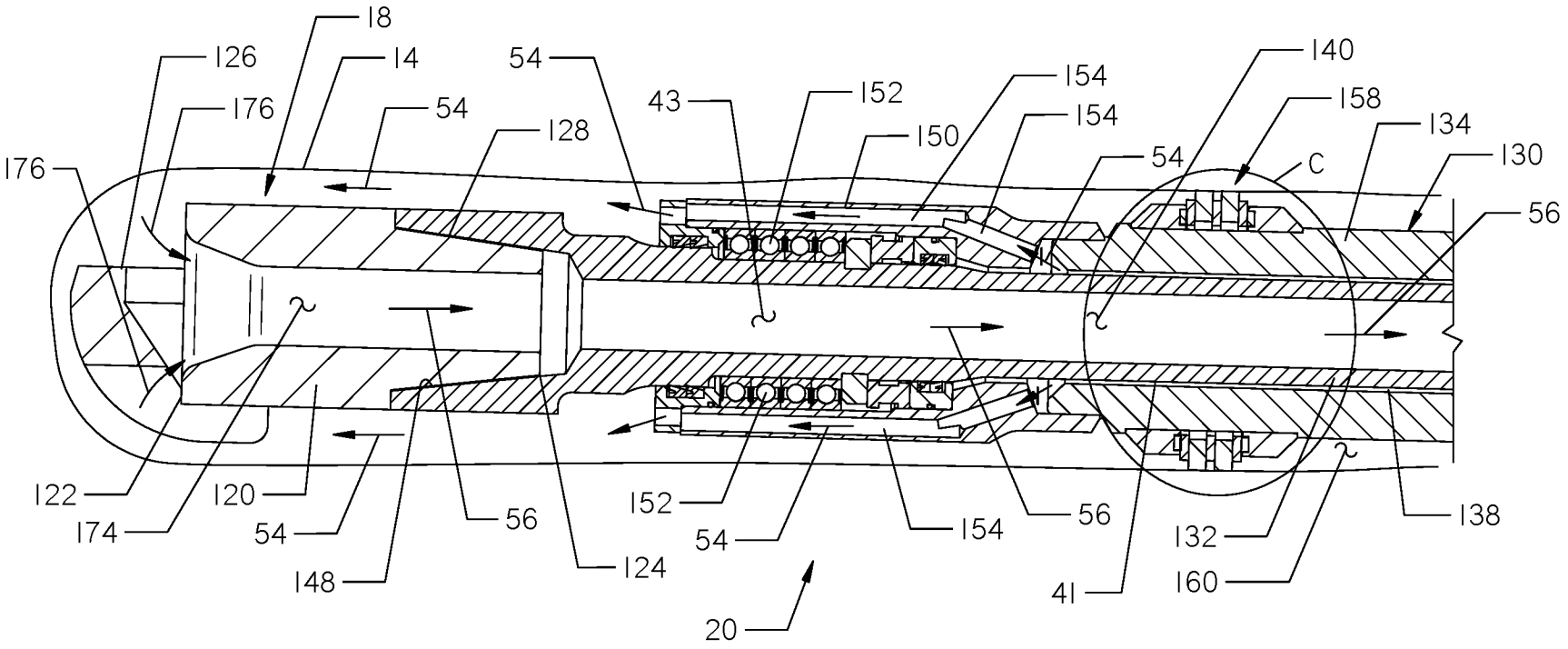
FIG. 12 is an enlarged view of the front portion of the downhole tool shown in FIG. 11. The downhole tool is shown positioned within a borehole.

Turning now to FIGS. 9-12, the boring tool 18 is operatively engaged to the first end 20 of the drill string 16. The boring tool 18 comprises a body 120 having opposed first and second ends 122 and 124, as shown in FIGS. 11 and 12. Cutting elements 126 are supported on the first end 122 of the body 120, and external threads 128 are formed in the outer surface of the body 120 adjacent its second end 124, as shown in FIGS. 11 and 12. The cutting elements 126 may include segments of polycrystalline diamond compacts (PDC), carbide, cubic boron nitride (CBN), or other suitable rock and soil cutting material. The boring tool 18 is one example of what is known in the art as a "reverse circulation drill bit". In alternative embodiments, any variation of a reverse circulation drill bit may be used with the system described herein. For example, a reverse circulation rotary (tri-cone) bit may be used.

One of the pipe assemblies 30 included in the drill string 16 may be a terminal pipe assembly 130. The terminal pipe assembly 130 is situated at the first end 20 of the drill string 16 and is configured for connection to the boring tool 18. The terminal pipe assembly 130 comprises a terminal inner member 132 nested within a terminal outer member 134. The terminal pipe assembly 130 may also be referred to in the art as a "beacon housing" or a "downhole tool". A locating transmitter or beacon (not shown) may be housed within the walls of the terminal outer member 134. The beacon may be accessible through a beacon cover 136, shown in FIGS. 9 and 10.

The terminal inner member 132 is nested within the terminal outer member 134 such that the members cooperate to define boundaries of an annular space 138. The annular space 138 comprises a segment of the first fluid path 41. The terminal inner member 132 also has a longitudinal internal bore 140 that comprises a segment of the second fluid path 43.

With reference to FIG. 11, the terminal inner member 132 has a pin end 142 that is identical to the pin end 46, shown in FIG. 2. In contrast to the box ends 50 of the inner members 32, the terminal inner member 132 has an enlarged box end 146 that projects from the terminal outer member 134 and has internal threads 148, as shown in FIGS. 11 and 12. The box end 146 is configured for mating with the external threads 128 formed on the boring tool 18.

The terminal outer member 134 has a female threaded end 144 that is identical to the female threaded end 44, shown in FIG. 2. Rather than having a male end opposed to its female end 44, the terminal outer member 134 has an enlarged front section 150 that houses a plurality of bearings 152. The bearings 152 are engaged with the terminal inner member 132, as shown in FIGS. 11 and 12. The bearings 152 allow the terminal inner member 132 to rotate relative to the terminal outer member 134, while permitting thrust to be transferred from the terminal inner member 132 to the boring tool 18. The bearings 152 accordingly allow the inner string 26 to rotate relative to the outer string 28.

Figure 9:
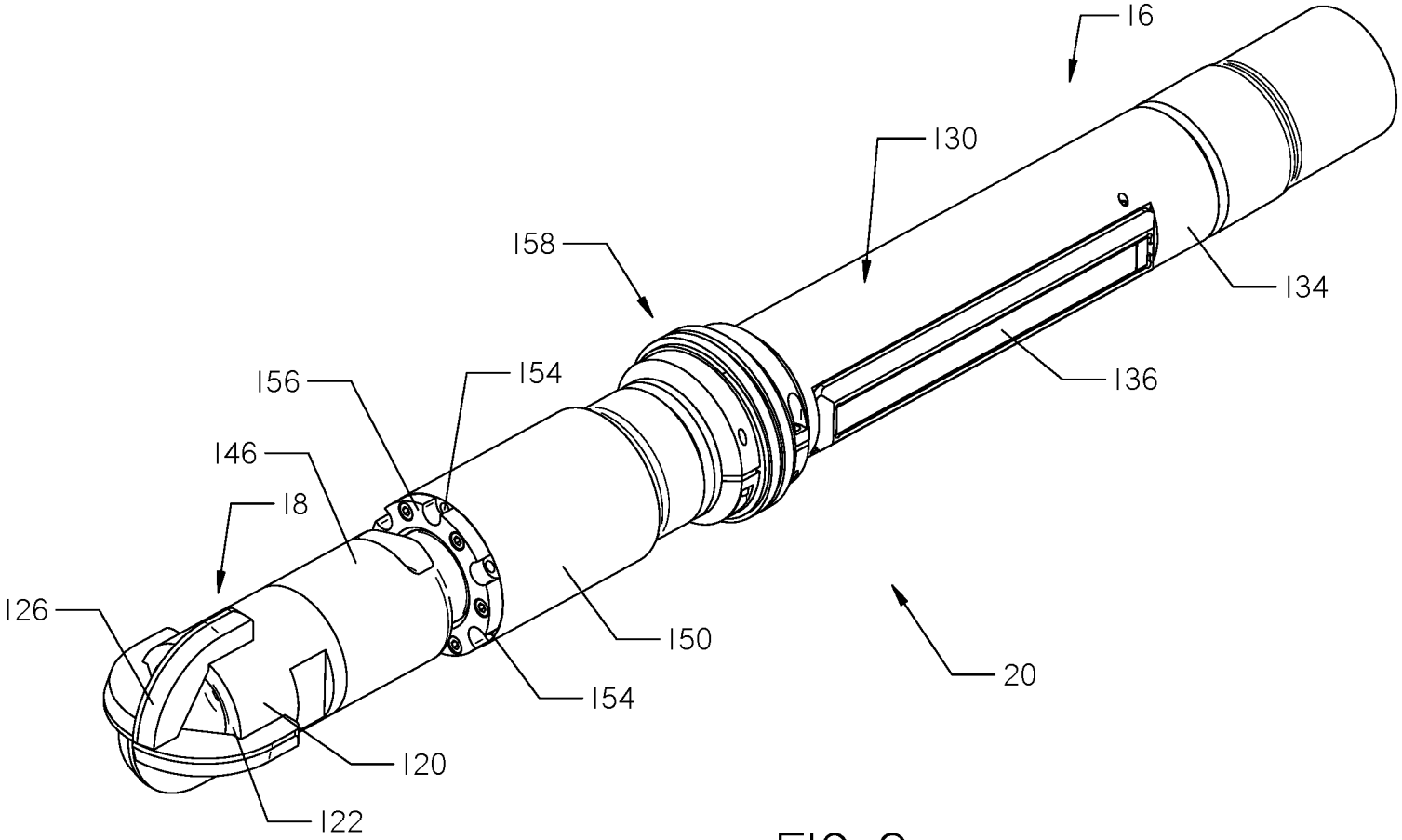
FIG. 9 is a perspective view of a downhole tool included in the dual-member drill string shown in FIG. 1.
Figure 10:
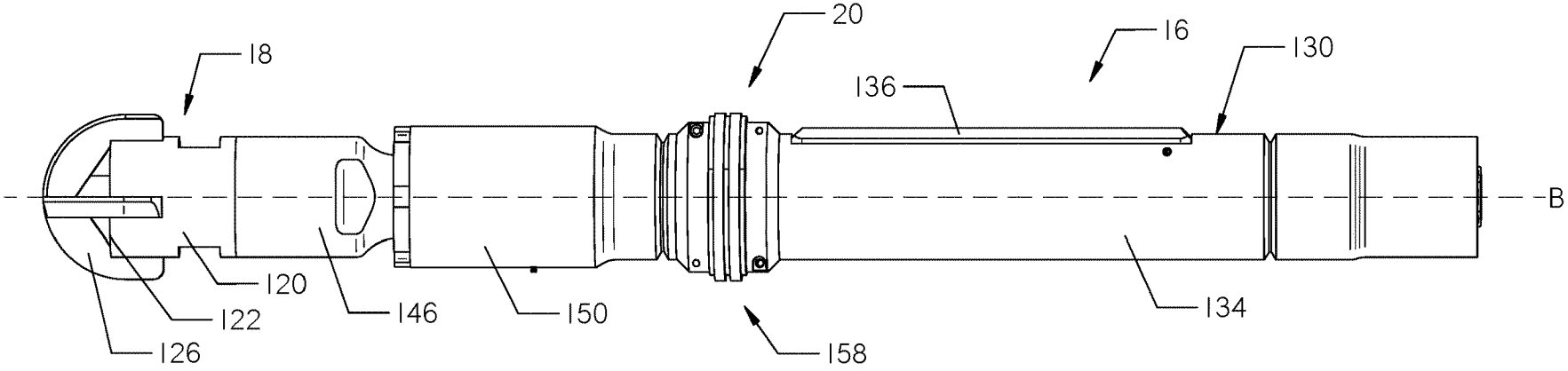
FIG. 10 is a right side elevation view of the downhole tool shown in FIG. 9.

With reference to FIGS. 11 and 12, the annular space 138 formed in the terminal pipe assembly 130 opens into a plurality of passages 154 formed within the box end 150. The passages 154 each open on a front surface 156 of the box end 150, as shown in FIGS. 9 and 11. Fluid traveling along the first fluid path 41 exits the path through the passages 154, as shown by arrows 54 in FIG. 12. Fluid exiting the passages 154 is exposed to the boring tool 18 and the borehole 14.

One or more baffle elements 158, which are shown in FIGS. 9-12 and 13-15, are supported on the exterior of the drill string 16 adjacent its first end 20. Two baffle elements 158 are shown in the figures. The baffle elements 158 are configured to block fluid exiting the first fluid path 41 from flowing upwardly into an annulus 160. The annulus 160 is the space between the drill string 16 and the walls of the borehole 14. Instead, the discharging fluid is directed toward the boring tool 18, as shown by arrows 54. There, the discharging fluid cools and lubricates the boring tool 18, clears spoils, and helps to stabilize the borehole 14. If there is significant fluid escape into the annulus 160, insufficient fluid levels at the boring tool 18 may result. The baffle elements 158 also prevent solid spoils carried by the fluid from entering the upper portion of the annulus 160. There, the spoils may become trapped and interfere with drill string rotation.

Figure 13:
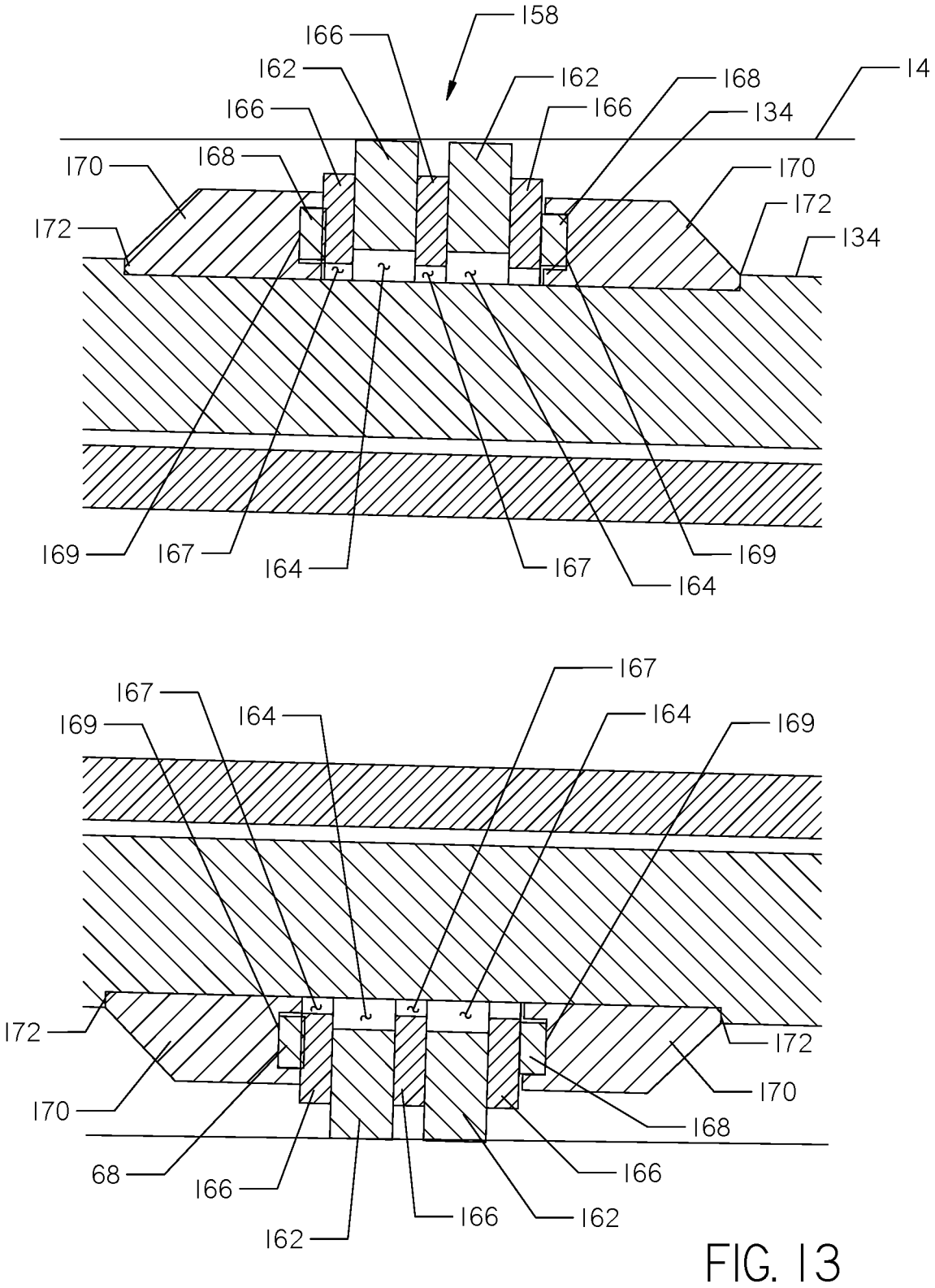
FIG. 13 is an enlarged view of area C from FIG. 12.

With reference to FIG. 13, each baffle element 158 comprises a seal 162 having an annular shape. The terminal pipe assembly 130 is disposed through the center of each seal 162, such that an inner diameter of each seal 162 is positioned adjacent the outer surface of the terminal outer member 134. An outer diameter of each seal 162 engages and seals against the walls of the borehole 14 during operation of the machine 10. Thus, the seals 162 are each sized so that they extend between the outer surface of the terminal pipe assembly 130 and the walls of the borehole 14. The seals 162 are preferably made from urethane, rubber, layered belting material, or other flexible material that is substantially resistant to abrasions. Because the seals 162 are flexible, they may form a tight seal without causing excessive drag along the walls of the borehole 14.

Figure 14:
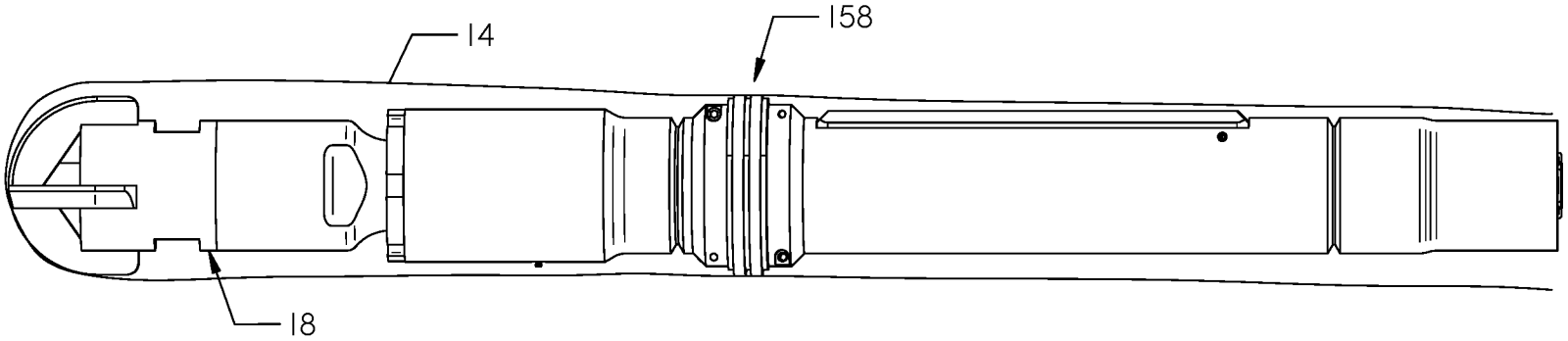
FIG. 14 shows the downhole tool of FIG. 10, positioned within a borehole.
Figure 15:
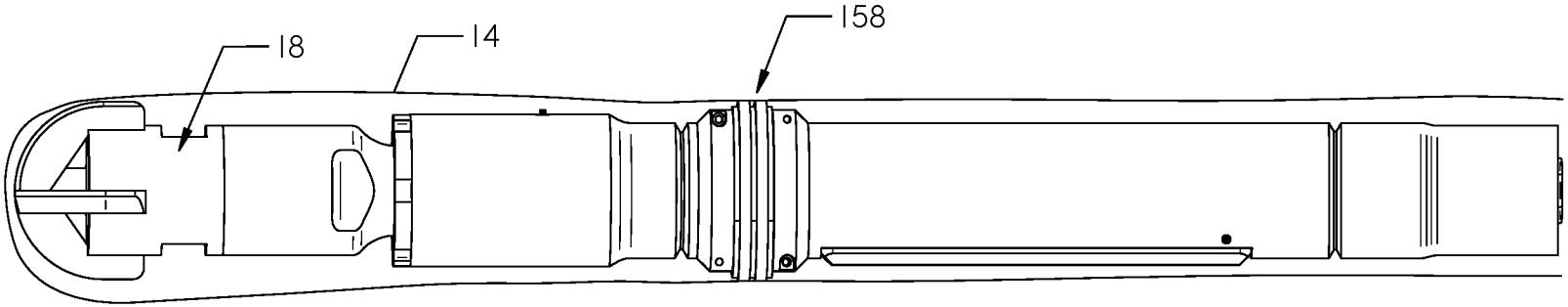
FIG. 15 shows the downhole tool of FIG. 13 after rotation about its axis by an angle of 180 degrees.

The inner diameter of each seal 162 is larger than the outer diameter of the terminal outer member 134. The size difference creates a space 164 between each of the seals 162 and the terminal outer member 134. Each space 164 allows limited lateral displacement of its associated seal 162 relative to the longitudinal axis of the terminal pipe assembly 130. The seals 162 are configured for lateral displacement because a portion of the drill string 16 may wobble adjacent the boring tool 18 as the outer string 28 rotates, as shown in FIGS. 14 and 15. The wobble is caused by a steering mechanism used with the drill string 16. Lateral displacement allows the seals 162 to maintain contact with the borehole walls even as the drill string 16 wobbles during rotation.

Continuing with FIG. 13, each of the seals 162 is sandwiched between a pair of support rings 166, each having an annular shape. The support rings 166 maintain a desired spacing between adjacent pairs of seals 162 and provide support and stability to the seals 162 during operation of the machine 10. The support rings 166 are preferably made of a rigid plastic material, such as high-density polyethylene or nylon, a metal, such as stainless steel or aluminum, or of a composite material, such as a carbon fiber composite.

Each support ring 166 has an outer diameter that is smaller than the outer diameter of the seal or seals 162 that it sandwiches. This construction assures that the seals 162 will be the primary contact between the drill string 16 and the walls of the borehole 14 during operation of the machine 10. Like the seals 162, each support ring 166 preferably has an inner diameter that is larger than the outer diameter of the terminal outer member 134. The size difference creates a space 167 between each of the rings 166 and the terminal outer member 134. Thus, each support ring 166 may be laterally displaced, along with its associated seal or seals 162, relative to the longitudinal axis of the terminal pipe assembly 130.

The seals 162 and support rings 166 are sandwiched between a pair of clamps 170. The clamps 170 are seated on opposite sides of an endless groove 172 formed in the outer surface of the terminal outer member 134. The groove 172 restrains the clamps 170 from axial movement during operation of the machine 10. The clamps 170 maintain the seals 162 and support rings 166 in the desired position on the terminal pipe assembly 130.

Preferably, a pair of annular spring washers 168 are positioned within grooves 169 formed in each of the clamps 170 and surround the terminal outer member 134. Each spring washer 168 engages an outer ring 166 and applies a compressive force that operates against the seals 162 as well as the rings 166. The spring washers 168 allow limited axial movement of the seals 162 and rings 166 between the clamps 170. In alternative embodiments, conical spring washers, or resilient springs composed of an elastomeric material, such as rubber or urethane, could be used in place of the spring washers 168.

The baffle elements 158 are shown supported on the terminal pipe assembly 134 in the figures. In alternative embodiments, the baffle elements may be supported on a different pipe assembly that is positioned nearer the second end 22 of the drill string 16. The figures depict one possible embodiment of the baffle elements 158. In alternative embodiments, the baffle elements may comprise any devices known in the art to prevent the flow of fluid along the annulus between the drill string and the borehole. For example, the baffle elements may comprise a shroud or an inflatable ring-shaped bladder.

Turning back to FIG. 12, because the expended fluid cannot return to the ground surface 12 through the annulus 160, the fluid must return to the ground surface 12 through the drill string 16. A fluid passage 174 is formed in the body 120 of the boring tool 18. The fluid passage 174 opens on the external surface of the body 120 adjacent the cutting element 126. When the boring tool 18 is attached to the drill string 16, the fluid passage 174 communicates with the second fluid path 43.

With reference to FIGS. 8 and 12, fluid discharged from the first fluid path 41 picks up spoils generated by the cutting element 126. The fluid, with its entrained spoils, flows into the fluid passage 174, as shown by arrows 176 in FIG. 12. After entering the fluid passage 174, the fluid and spoils mixture flows along the second fluid path 43 to the ground surface 12, as shown by arrows 56. Once at the ground surface 12, the fluid and spoils mixture may discharge through a rear opening 178 of the spindle 82, as shown by arrow 181 in FIG. 8. A holding structure may capture spoils that have been entrained in the fluid that discharges from the rear opening 178 of the spindle 82. For example, the holding structure could be a cyclonic separator that removes spoils from the airstream.

At the outset of a drilling operation, fluid expelled from the first fluid path 41 is not initially routed towards the boring tool 18. Such routing does not occur until the borehole 14 further deepens, and the drill string 16 brings the baffle elements 158 into sealing contact with the walls of the borehole 14. In the meantime, fluid expelled from the first fluid path 41 escapes from the borehole 14, enters the atmosphere, and performs none of the functions required at the boring tool 18. To solve this problem, fluid may be delivered to the boring tool 18 through the second fluid path 43 until the baffle elements 158 engage the walls of the borehole 14.

Continuing with FIG. 8, a second injection inlet 180 is supported on the spindle 82 adjacent the rear end 88 of the gearbox 82. The second injection inlet 180 communicates with the second fluid path 43. The inlet 180 comprises a coupler 182 configured for connection to a hose used to supply fluid. Fluid entering the second fluid path 43 from the second injection inlet 180 may flow from the ground surface 12 to the boring tool 18. The fluid exits the boring tool 18 through the fluid passage 174, shown in FIG. 12. Discharging fluid helps to cool and lubricate the boring tool 18, clears spoils and helps to stabilize the borehole 14. The expelled fluid and entrained spoils may flow through the annulus 160 and leave the borehole 14 at the ground surface 12.

Figure 17:
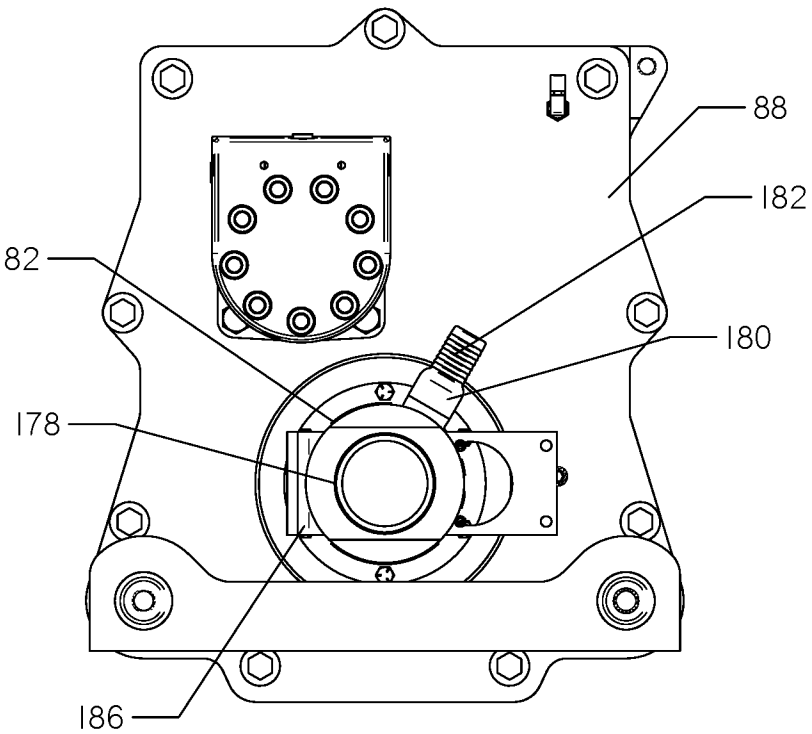
FIG. 17 shows the gearbox assembly of FIG. 16. The sliding gate has been moved to its closed position.
Figure 16:
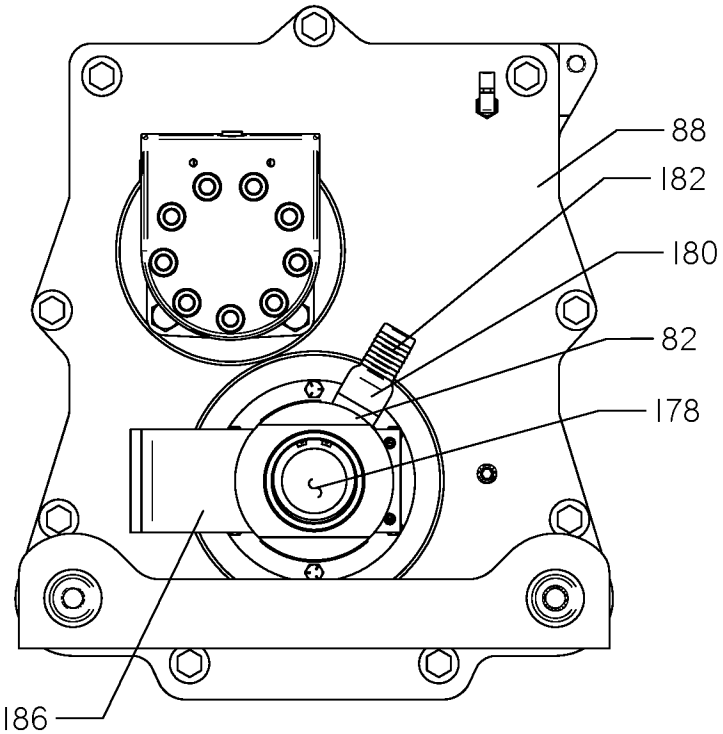
FIG. 16 is a rear elevation view of the gearbox shown in FIG. 6. The sliding gate is in its open position.

With reference to FIGS. 16 and 17, a valve 184 is incorporated into the spindle 82 adjacent its rear opening 178. The valve 184 is opened and closed by way of a sliding gate 186. When the valve 184 is closed, fluid injected into the second fluid path 43 is forced towards the boring tool 18. When the valve 184 is open, no fluid is injected into the second fluid path 43 from above ground. Instead, the second fluid path 43 carries fluid and spoils from underground, and discharges them above ground level through the opening 178 of the spindle 82. The valve 184 is known in the art as a "sliding gate valve". In alternative embodiments, a ball valve or any other kind of flow control device known in the art may be used in place of the valve 184.

When drilling operations start, the valve 184 is closed and fluid is delivered to the boring tool 18 through the second fluid path 43. Once the baffle elements 158 are engaged with the walls of the borehole 14, the valve 184 is opened, fluid delivery to the second fluid path 43 is stopped, and fluid delivery to the first fluid path 41 is begun. Should the fluid passage 174 become clogged and block the first fluid path 41, fluid delivery to the second fluid path 43 may be resumed.

Figure 18:
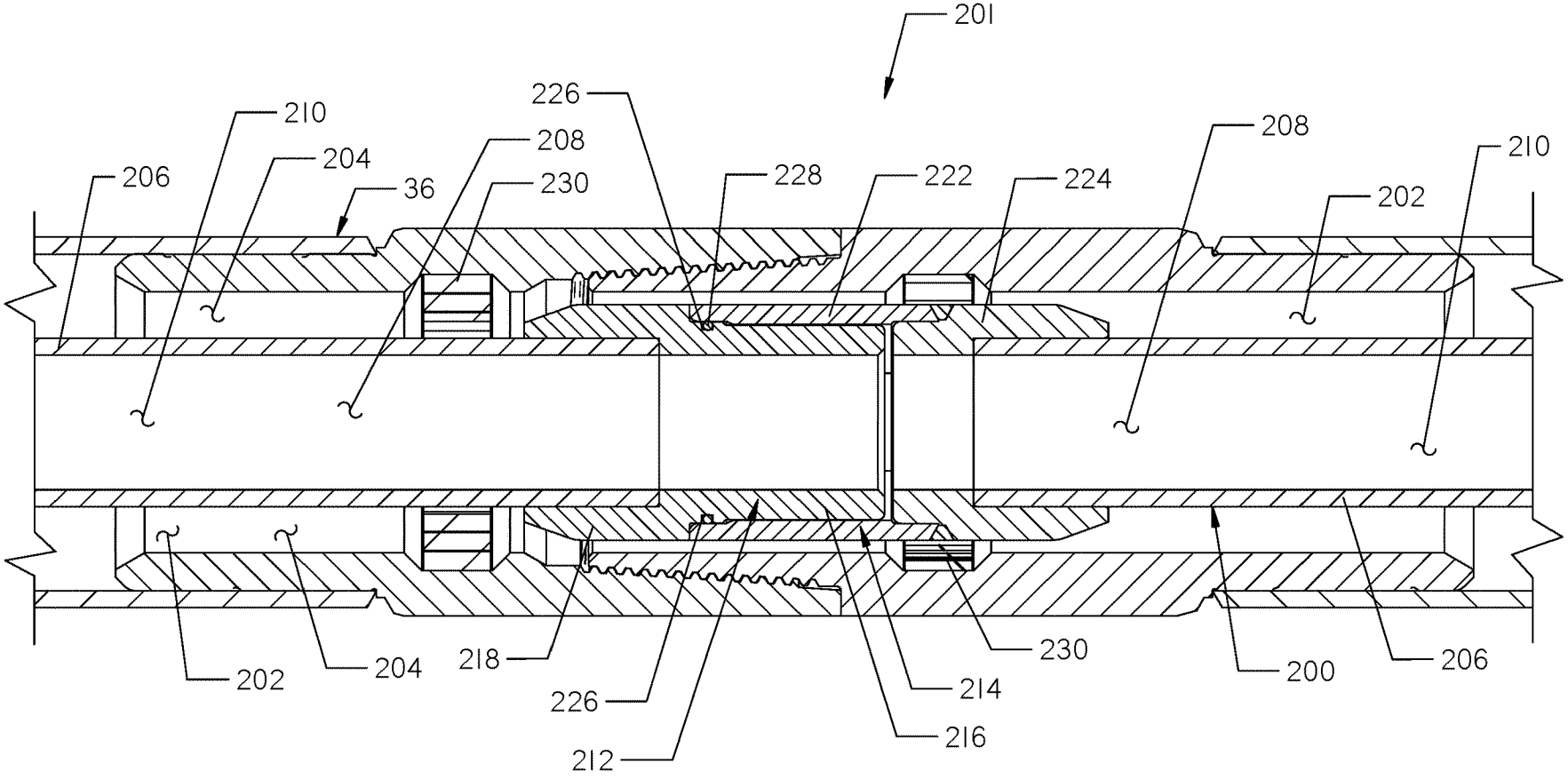
FIG. 18 is a cross-sectional view of an alternative embodiment of one of the pipe joints making up the dual-member drill string shown in FIG. 1.
Figure 19:
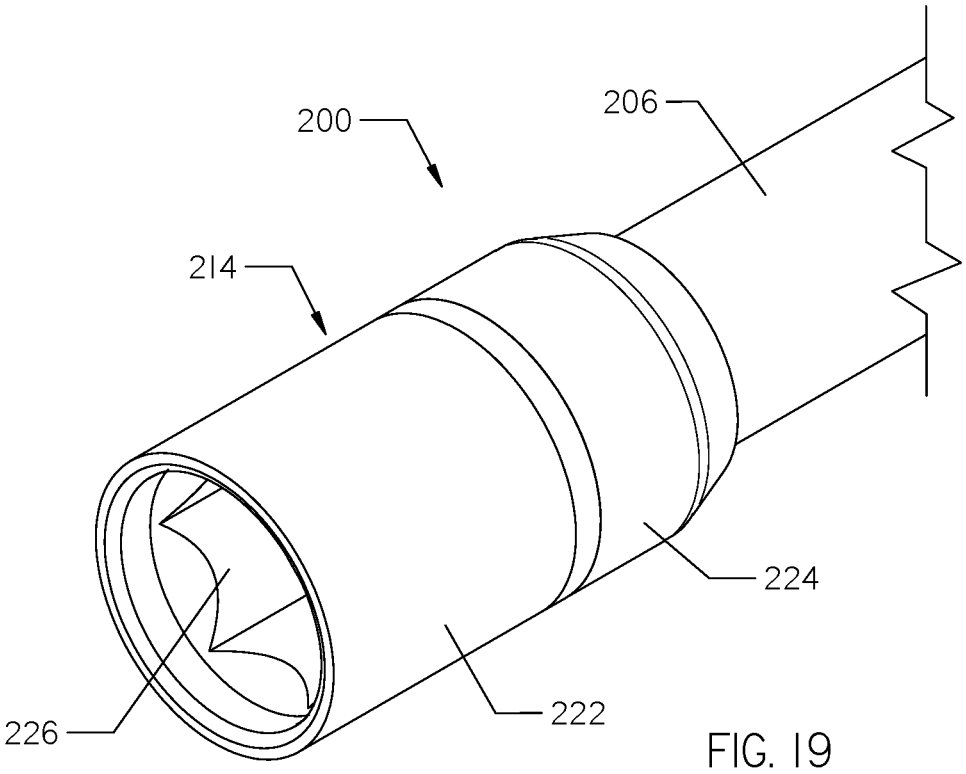
FIG. 19 is a perspective view of an alternative embodiment of the box end of the inner member shown in FIG. 18.
Figure 20:
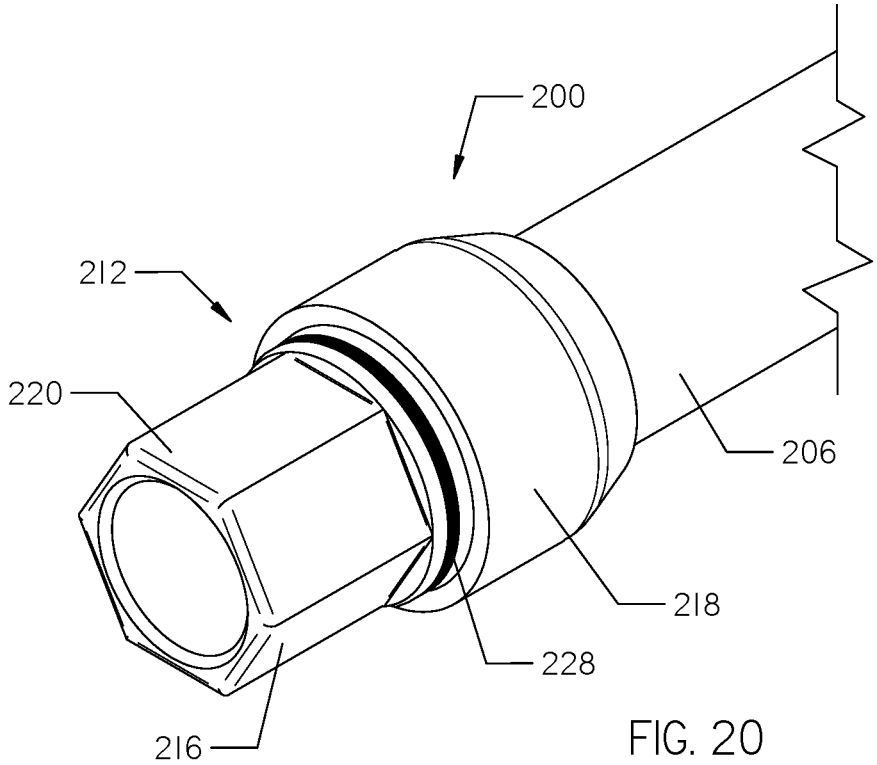
FIG. 20 is a perspective view of an alternative embodiment of the pin end of the inner member shown in FIG. 18.

With reference to FIGS. 18-20, an alternative embodiment of an inner member 200 is shown. The inner member 200 may be disposed within an outer member 36 to form an alternative embodiment of a dual-member pipe assembly 201. The inner member 200 is nested within the outer member 36 such that the members cooperate to define boundaries of an annular space 202. Each annular space 202 forms a segment of a first fluid path 204. The first fluid path 204 operates identically to the first fluid path 41, shown in FIG. 2.

Each inner member 200 has an elongate body 206 extending between opposed connector sections. A longitudinal internal bore 208 extends through the body 206 and the connector sections. The bore 208 comprises a segment of a second fluid path 210. The second fluid path 210 operates identically to the second fluid path 43, shown in FIG. 2.

The connector sections comprise a pin end 212 and an opposed box end 214. The pin end 212 has a first section 216 joined to a second section 218. The first section 216 has a polygonal outer profile 220, shown in FIG. 20, identical to the polygonal outer profile 48 on the pin end 46, shown in FIG. 4. The second section 218 surrounds the outer surface of the elongate body 206 and attaches the pin end 212 to the body 206. The second section 218 has a larger maximum cross-sectional dimension than the first section 216 and the body 206.

Similarly, the box end 214 comprises a first section 222 joined to a second section 224. The first section 222 has a polygonal inner profile 226, shown in FIG. 19, identical to the polygonal inner profile 52 on the box end 50, shown in FIG. 3. The second section 224 surrounds the outer surface of the elongate body 206 and attaches the box end 214 to the body 206. The first and second sections 222 and 224 have the same maximum cross-sectional dimension. Such dimension is larger than the maximum cross-sectional dimension of the body 206.

With reference to FIG. 18, the internal bore 208 has the same internal diameter throughout the entire length of the inner member 200. Thus, the second fluid path 210 remains a consistent size as it passes through adjacent pipe assemblies 201. Such sizing is permitted because the pin and box ends 212 and 214 are attached to the outer surface of the inner member 200, not its inner surface.

In contrast, a portion of the pin and box end 46 and 50 shown in FIG. 2 are attached to the inner surface of the inner member 32. As a result, the internal diameter of the internal bore 34 decreases as it passes through the pin and box end 46 and 50, as shown in FIG. 2. Thus, the second fluid path 43 varies in size throughout the drill string 16. As such, fluid and spoils may flow more efficiently along the second fluid path 210 than the second fluid path 43.

Continuing with FIGS. 18 and 20, an endless groove 226 is formed in the outer surface of first section 216 of the pin end 212. The groove 226 extends concentrically around the internal bore 208 of the inner member 200. In alternative embodiments, the endless groove may be formed in the inner surface of the box end.

A fluid seal 228, which is annular in shape, is positioned within the groove 226. The seal 228 is identical to the seal 62, shown in FIGS. 2 and 4. The seal 228 engages with the inner surface of the box end 214 and prevents fluid from leaking between the first and second fluid paths 204 and 210. A plurality of annular spacers 230 may also be positioned within the annular spaces 202. The spacers 230 are identical to the spacers 58, shown in FIG. 2.

Turning back to FIG. 1, while the machine 10 is shown positioned on the ground surface 12, the system described herein may be used with a pit-launched or below ground-level drilling machine known in the art. In such case, the drill string may have a first end positioned below ground level and an opposed second end positioned below ground level.

Various modifications can be made in the design and operation of the present invention without departing from the spirit thereof. Thus, while the principle preferred construction and modes of operation of the invention have been explained in what is now considered to represent its best embodiments, which have been illustrated and described, it should be understood that the invention may be practiced otherwise than as specifically illustrated and described.

The invention claimed is:

1. A pipe assembly, comprising:

a hollow outer member;

a hollow inner member having a longitudinal internal bore, the inner member at least partially nested within the outer member and cooperating with the outer member to define boundaries of an annular space, in which the inner member is characterized by a pin end having a polygonal outer profile and an opposed box end having a polygonal inner profile; and in which the inner member is rotatable independently of the outer member;

an endless groove formed in the inner member and surrounding the internal bore; and a fluid seal received within the endless groove.

2. The pipe assembly of claim 1 in which the inner profile of the box end is complementary to the outer profile of the pin end.

3. A system, comprising:

a drill string formed from a plurality of pipe assemblies of claim 1 arranged in end-to-end and torque-transmitting relationship, the drill string having a first end situated in an underground borehole and an opposed second end situated above ground.

4. The system of claim 3, further comprising:

an above-ground horizontal directional drilling rig, comprising:

a frame having opposed first and second ends;

a carriage supported on the frame, movable between the frame's first and second ends, and gripping the drill string adjacent its second end.

5. The system of claim 3, in which an annulus exists between the underground drill string and the walls of the borehole, and further comprising:

one or more baffle elements externally supported by the drill string and configured to block fluid flow within the annulus.

6. The system of claim 5 in which each baffle element comprises:

an annular seal that is movable relative to the drill string.

7. The pipe assembly of claim 1, further comprising:

a spacer positioned within the annular space and configured to maintain the inner and outer members in concentric relationship.

8. The pipe assembly of claim 7 in which the spacer is traversed by at least one fluid passage.

9. A drill string having a first end situated in an underground borehole and an opposed second end situated above ground, comprising:

a plurality of pipe assemblies arranged in end-to-end and torque-transmitting relationship, each pipe assembly comprising:

a hollow outer member; and a hollow inner member having a longitudinal internal bore, the inner member at least partially nested within the outer member and cooperating with the outer member to define boundaries of an annular space, in which the inner member is rotatable independently of the outer member;

in which the annular spaces of the plurality of pipe assemblies comprise segments of a first fluid path within the drill string, and the internal bores of the plurality of pipe assemblies comprise segments of a second fluid path within the drill string, the drill string further comprising:

a plurality of fluid seals, each fluid seal interposed between adjacent pipe assemblies of the drill string and surrounding the second fluid path.

10. The drill string of claim 9 in which an annulus exists between the underground drill string and the walls of the borehole, and further comprising:

one or more baffle elements externally supported by the drill string and configured to block fluid flow within the annulus.

11. The drill string of claim 10 in which each baffle element comprises:

an annular seal that is movable relative to the drill string.

12. The drill string of claim 9, further comprising:

a boring tool supported by the drill string adjacent its first end and comprising:

a body having a fluid passage communicating with the second fluid path, and an external surface at which the fluid passage opens; and a cutting element supported by the body and situated adjacent the opening of the fluid passage on the external surface.

13. A method of using the drill string of claim 9, comprising:

flowing fluid on the first and second fluid paths, the direction of fluid flow on the first fluid path opposed to the direction of fluid flow on the second fluid path.

14. A method of using the drill string of claim 9, comprising:

flowing compressed air along at least a portion of the first fluid path.

15. The method of claim 14, further comprising:

flowing spoils and compressed air along at least a portion of the second fluid path.

16. A method of using the drill string of claim 9, comprising:

injecting compressed air into the first fluid path at a site above ground level;

driving the drill string such that its first end moves in a horizontal direction below ground level; and collecting spoils that discharge from the second fluid path at a site above ground level.

17. The method of claim 16, further comprising:

injecting liquid into the first fluid path at a site above ground level, the liquid having a flow rate of less than five gallons per minute.

18. The method of claim 17 in which the compressed air and liquid are injected concurrently.

19. An elongate drill string having a first end situated in an underground borehole, an opposed second end situated above ground, and mutually exclusive first and second fluid paths, each fluid path extending between the first and second ends, comprising:

a plurality of pipe assemblies arranged in end-to-end and torque-transmitting relationship and comprising a rotatable outer string within which is situated an independently rotatable inner string, each pipe assembly including segments of the first fluid and second fluid paths; in which the first fluid path surrounds the second fluid path; and a plurality of fluid seals, each fluid seal interposed between adjacent pipe assemblies of the drill string and surrounding the second fluid path.

20. The drill string of claim 19 in which an annulus exists between the underground drill string and the walls of the borehole, and further comprising:

one or more baffle elements externally supported by the drill string and configured to block fluid flow within the annulus.

21. The drill string of claim 19 in which none of the plurality of fluid seals surrounds the first fluid path.

22. A method of using the system of claim 5, comprising:

driving the drill string such that its first end moves in a horizontal direction below ground level; and engaging the one or more baffle elements with one or more walls of the underground borehole as the drill string is driven in a horizontal direction.

* * * * *